United States Patent [19]

Warren et al.

[11] 4,382,421

[45] May 10, 1983

[54] TUBE COATING APPARATUS

[75] Inventors: David A. Warren, Cypress; Edwin D. McCrory, Jr., Houston, both of Tex.

[73] Assignee: Vetco, Inc., Ventura, Calif.

[21] Appl. No.: 324,191

[22] Filed: Nov. 23, 1981

Related U.S. Application Data

[62] Division of Ser. No. 139,380, Apr. 11, 1980.

[51] Int. Cl.[3] ..... B05C 7/02

[52] U.S. Cl. ..... 118/663; 118/50; 118/308; 118/318

[58] Field of Search ..... 118/408, 318, 50, 56, 118/663, 692, 308, 312; 427/181, 182, 183

[56] References Cited

U.S. PATENT DOCUMENTS

| | | | |
|---|---|---|---|
| 3,207,618 | 9/1965 | De Hart | 427/182 |
| 3,532,531 | 10/1970 | Stallard | 427/183 |
| 3,974,306 | 8/1976 | Inamura et al. | 427/181 X |
| 3,982,050 | 9/1976 | Kato et al. | 427/181 |
| 4,122,798 | 10/1978 | Gibson | 118/53 |
| 4,243,699 | 1/1981 | Gibson | 427/183 |
| 4,287,224 | 9/1981 | Heimbach et al. | 427/8 X |

FOREIGN PATENT DOCUMENTS

| | | | |
|---|---|---|---|
| 51-52444 | 1/1976 | Japan | 427/238 |
| 1020253 | 2/1966 | United Kingdom | 427/182 |

*Primary Examiner*—John P. McIntosh
*Attorney, Agent, or Firm*—Edward L. Kochey, Jr.

[57] ABSTRACT

An apparatus for coating the interior of a tube (10) with fusible particles entrained in a flow of air. A measured charge is placed in an unpacked condition within a container (18) temporarily isolated (20) from a first end of the tube. A vacuum is established in the tube and in a tank (34) connected to the second end of the tube. A quick-opening valve (20) thereafter places the container in fluid communication with the first end of the tube.

11 Claims, 3 Drawing Figures

TUBE COATING APPARATUS

This is a division of application Ser. No. 139,380, filed Apr. 11, 1980.

BACKGROUND OF THE INVENTION

This invention relates to the internal coating of a heated tube and in particular to a coating process wherein fusible particles are transported through the tube in a flow of air.

It is frequently advantageous to coat the inside of steel tubing with nonmetallic linings. Properly selected linings can protect the tube against erosion or corrosion. A coating surface which is smoother than that of the tubing itself can result in a decreased pressure drop of fluid flowing through the tube. For such a purpose materials have been used such as polypropylene, chlorinated polyether, various polyester, certain epoxy and vinyl polymers, polyethylene, polytetrafluoroethylene, and nylon. These materials may be either thermoplastic of thermosetting, and are normally applied to the tube after it has been heated.

It is desirable that the internal coating be free from voids or pin holes. It also should have a uniform thickness and a smooth surface. The method used to coat the tube should be both reproducible and simple in operation.

It is known to heat and rotate the tube to be coated so that fusible particles conveyed in an air stream and injected into the tube will stick to the surface and form a coating thereover. There have been many methods, along with apparatus therefor, suggested involving this general concept of coating a tube.

Fluidized beds have been suggested as a supply source for the fusible particles from which location they are carried through the tube in a stream of air. This is generally a continous flowing stream with excess particles collected at the other end. In some cases the apparatus provides a means for reversing flow through the tube from a second fluidized bed to promote uniformity of coating of the tubing.

It has been suggested to use a timed pulse of flow carrying the fluidized particles followed with a flow of particle-free air scavenging the tube.

These various methods in general require a significant excess of particle flow and/or timing of the cycle. Effectiveness of this operation requires that the timer be consistent and readily adjustable and that there be no leaks in the system whereby the timing would not represent an appropriate particle flow. A uniform, preferably thin and smooth coating, remains difficult to obtain in a consistent and reproducible manner.

SUMMARY OF THE INVENTION

The tube to be coated is heated, horizontally supported, and rotated in accordance with common practice. The first end of the tube to be coated is connected to a charging container with a pipe including a quick-opening valve which is closed at this time. A measured charge of the coating material is placed in the container.

The second end of the tube is connected with a pipe to a vacuum tank. A vacuum pump places the tank and the tube under vacuum. The valve is suddenly opened so that flow suddenly occurs from the container into the tube carrying the fusible particles with it. The vacuum in the tank and the tube causes a high initial flow rate which decreases with time as the vacuum is dissipated by the inflowing air. The vacuum pump may or may not be operated during this time.

An additional valve may be added between the tube and the vacuum tank so that vacuum may be drawn within the tank while the tube is being placed into position. The valve is then opened to place the tube under vacuum as well as the tank; and when the vacuum has been established at the proper level, the quick-opening valve initiates the process as described above.

The apparatus for carrying out this method includes a measuring means for depositing only a predetermined quantity of fusible particles within the container. These particles are placed within the container in an unpacked condition either by using a fluidized bed or by pouring them into the chamber over a fall breaking apparatus which will permit the particles to remain in a fluffed condition for sufficient time to achieve operation of the apparatus.

The vacuum level in the tank is sensed, and means are provided for opening the quick-opening valve in response to a preselected vacuum level.

A plurality of vacuum tanks may be connected to the initial tank to provide a controllable variation in the volume which is evacuated. This provides ability to easily manipulate the time rate of flow variation when opening the quick-opening valve.

DESCRIPTION OF THE PREFERRED EMBODIMENT

Figure 1:
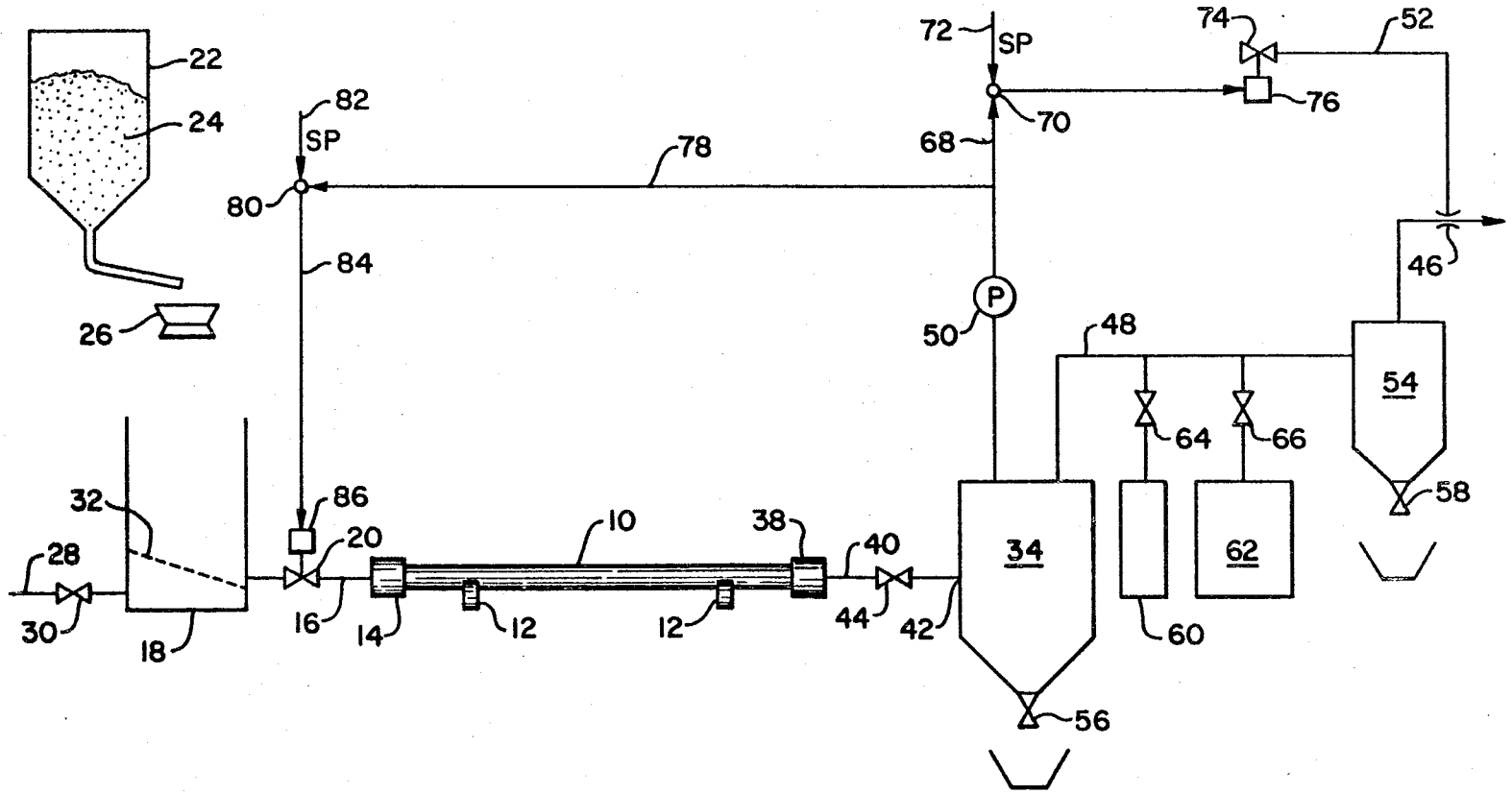
FIG. 1 illustrates a schematic arrangement of the system including elementary controls.

The tube to be coated 10 is first cleaned and preferably internally sand blasted to white metal. A primer may or may not be applied to the clean surface. This tube is then preheated to a temperature level above the melting point of the powder which will be deposited on the internal surface. The actual temperature level depends on the coating material to be used.

This tube is then placed on rolls 12 while still hot and rotated at a predetermined speed such as 100 rpm. This rotation aids circumferential distribution of the coating.

Air tight rotary connection 14 connects the first end of the tube to be coated by pipe 16 to a charging location within container 18. The pipe 16 includes a quick-opening valve 20 whereby the container may be selectively placed in fluid communication with the tube interior.

A hopper 22 contains a supply of powdered material which is to be used for coating the pipe. A predetermined weight of the fusible particles 24 are to be used to coat the interior of the tube. The desired amount of these particles for the tube to be coated are weighed in scale 26, and the selected charge is then placed within the container 18. They are located within the container at a location generally near the outlet through pipe 16 and are preferably maintained in a fluffed or unpacked condition. As illustrated, a fluidized bed is used wherein a supply of fluidizing air passes in through pipe 28 and valve 30 through bed support 32 in accordance with well-known fluidizing principles. Alternately the material could be placed in a container gently so that it retains a fluffed condition which may be maintained so long as the container is not unduly jarred or vibrated.

An imperforate vacuum tank 34 is connected to the second end of the tube 10 with an air tight rotary coupling 38. The connecting pipe 40 between the inlet connection 42 on the imperforate tank 34 and the rotary coupling 38 may include valve 44 if certain operation as described below is required. Otherwise this valve is not required.

A vacuum pump 46 such as an air ejector is in fluid communication with the tank 34 through pipe 48 and operates to place the tank under vacuum. With valve 20 closed and valve 44 either omitted or open, the tank and the interior of pipe 10 are both placed under vacuum. Because of the low flow rate through the pipe existing while establishing a vacuum, the vacuum level in the tank and the pipe are essentially the same and may be measured by pressure sensor 50.

Figure 2:
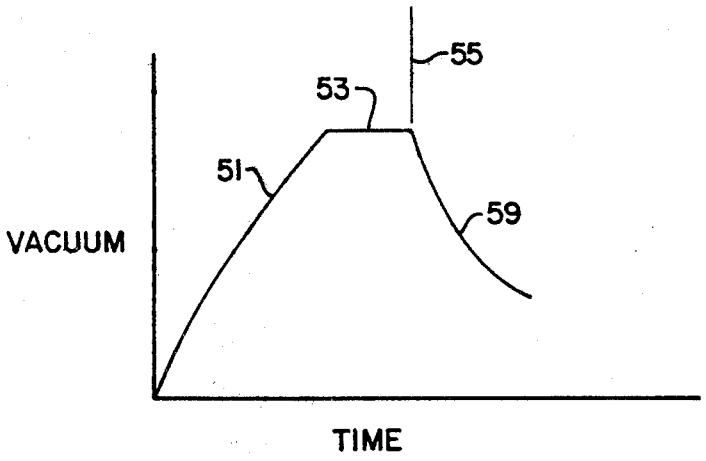
FIG. 2 illustrates the relationship between vacuum and time.

After the tube to be coated is placed on the rolls 10, rotatable coupling 14 and 38 are made up; and with valve 20 closed, the weighed charge is placed in tank 18. The vacuum pump 46 is operated by an air line 52; and a vacuum is drawn in the tank 34 and pipe 10. The vacuum level during this period is illustrated in FIG. 2, wherein the vacuum generally increases (51); and as illustrated, it is held at a preselected level (53).

When the vacuum reaches the desired level which is a function of the tank size, the pipe diameter and length, and the coating material used, quick-opening valve 20 is opened at time 55. This may be done as soon as the vacuum reaches the desired level, and the flat portion illustrated in FIG. 2 is not necessary.

Figure 3:
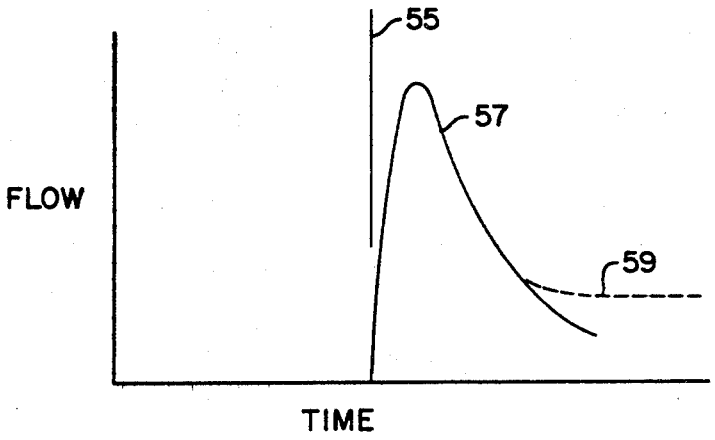
FIG. 3 represents the relationship between flow through the tube and time.

With the opening of valve 20 there is a sudden flow of air into the tube 10 as shown in FIG. 3 by curve 57. The vacuum in the tank decays as illustrated by 59 in FIG. 2. Accordingly, there is a sudden surge of air flow which then uniformly decreases. The sudden change in the particle environment from atmospheric pressure to the low pressure causes an explosion-like action which creates a cloud of powder which is conveyed through the tube. The rate of air flow peaks and decays in a manner related to the vacuum. Curve 59 shows the continuing air flow when the vacuum pump continues running.

The air flow pattern is a function of the tank volume and the tube size as well as the vacuum level. Some experimentation is at present required in order to determine the appropriate parameters for a particular tube and tube coating. For a particular coating too low, a tube temperature results in a considerable amount of the particles passing completely through the tube, poor adhesion, and a tendency for a powdery deposit. Any deposit also tends to be thin on the upstream end. On the other hand, too high a tube temperature not only involves handling tubes at unnecessarily high temperature levels and a waste of energy but also results in excessive coating at the upstream end of the tube.

A roughened internal surface seems to occur when the tube is too hot or when the powder is insufficiently fluffed in container 18.

Insufficient coating at the upstream end seems to be caused by too high a vacuum.

Insufficient coating at the downstream end tends to be caused by insufficient powder quantity or by too low a vacuum.

Inordinate wastage of material carried through the tube seems to be caused by too cool a tube.

Speculation on the reasons for the good results obtained in laboratory tests suggests that the result may be related to heat transfer requirements between the particles and the tube itself. High velocity is initially used when the incoming particles are radiantly exposed to the hot tubing whereby some stick at the upstream end and others are heated as they pass down the tube. The decreased flow with time retards those particles which have already passed to locations near the outlet, and the flow is reduced at a time when the particles within the dust cloud radiate not to the wall directly but to other particles which have already formed a portion of the surface. These particles, accordingly, radiate to a lower temperature level; and more time is required for heat transfer. The decreased air flow accommodates this need, and a uniform coating is obtained with little wastage.

The pipe 16 should be of a smaller diameter than the tube to be coated. This increases the velocity thru pipe 16 decreasing or avoiding the possibility of powder remaining in this pipe. Material left behind would cause erratic quantity delivery to the successive pipes being coated. The high velocity in pipe 16 as compared to the decreased velocity in the tube 10 results in good dispersal of the material with the tube.

Any particles which are carried through the system are collected in centrifugal vacuum tank 34 or in bag filter 54. These particles may be intermittently removed through valves 56 and 58, respectively. While these particles may be recycled for use, it still is not desirable to have a substantial amount of particles passing through the pipe. To the extent that there is large wastage at the pipe discharge, this provides an increasingly sizable percentage of the injected material which is passing completely through the pipe and not being deposited on the surface. The larger this amount the more variation there is in the actual pipe coating with variations in system operation.

Auxiliary vacuum tanks 60 and 62 are isolatably connected to the vacuum tank 34 through valves 64 and 66. These tanks may be cut in or out as desired thereby varying the volumetric capacity of the vacuum system. Accordingly, the time flow characteristic of the system may be adjusted.

The system may be automatically operated with pressure sensor 50 sending a control signal through control line 68 to a set point 70 where the signal is compared to a desired pressure level signal or set point 72. This may operate to maintain a vacuum level in the tank by varying the air flow through line 52 by modulating control valve 74 with controller 76. In the event that the preselected vacuum level is reached within the vacuum tank before the remainder of the system is prepared, this control will limit the vacuum and hold it at a preselected level.

The control signal indicative of pressure level from pressure sensor 50 also passes through control line 78 to set point location 80 where it is compared with a set point 82 which represents the desired pressure level at which the quick-opening valve 20 is to open. When the vacuum reaches the preselected level, a signal is sent through control line 84 to controller 86 which opens the quick-opening valve 20.

Depending on the characteristics of the particular vacuum pump 46 being used, it may be advantageous at times to include valve 44 which may be closed while pipe 10 is being changed. The vacuum pump may operate at this time to establish a vacuum in tank 34 while the pipe is being changed. When the new pipe is in place, valve 44 is opened with pipe 10 being evacuated at which time it would be ready to operate in accordance with the above-described procedure.

Experiments were carried out to internally coat pipe to a thickness of 20 to 23 micrometers. The pipe was a range 2 drill pipe which is a pipe approximately 9.5 meters long. The material used to coat the pipe was an epoxy melt mix of approximately the following composition: The particular material used was an epoxy powder prepared by Whittaker Coatings and Chemicals Co. of Colton, Calif., using the trade name, "Interior Oil Pipe Coating—E. S. Powder". The manufacturer code identification was 8502-B235.

Four different pipe sizes were tried, and the preferred quantities of powder, vacuum, and pipe temperature are set forth in Table 1. The vacuum setting given in the table is the trip point at which the quick-opening valve is opened. The vacuum tank had a volume of 0.125 cubic meters. Considering the connecting hoses as well as the pipe to be coated, the total volume varied from 0.221 cubic meters for 12.7 centimeter pipe down to 0.163 cubic meters for 8.9 centimeter pipe.

TABLE 1

| Pipe Size | Powder | Vacuum | | Pipe Temp. |
|---|---|---|---|---|
| cm | kg | mm | Hg | °C. |
| 12.7 | 1.8 | 12 | 7 | 160 |
| 11.4 | 1.5 | 11 | 4 | 160 |
| 10.2 | 1.2 | 10 | 2 | 160 |
| 8.9 | 1.0 | 10 | 2 | 160 |

The flexible hose connecting the charging location to the pipe was approximately 3.8 centimeters inside diameter. It was estimated that the velocity in this line was maintained at approximately 20 meters per second with the venturi vacuum system being kept in operation.

Satisfactory coatings were obtained over a range of about 28° C. from 140° C. to 170° C. It is, however, required that the end-to-end pipe temperature not vary more than 5° C. to 8° C. Some experimentation is obviously required to achieve the optimum conditions for other coating materials and pipe sizes.

We claim:

1. An apparatus for lining a heated tube comprising: means for supporting and rotating the tube to be lined; a container for holding fusible particles which are to be delivered to said tube; a feedpipe connected to said container and sealably connectable to one end of the tube to be coated; an imperforate tank having a volume greater than the tube to be coated, and having an inlet connection and an outlet connection; a discharge pipe connectable to the second end of the tube to be lined and connected to the inlet connection of said tank; a quick-opening valve located in said feedpipe; a vacuum pump connected to the outlet connection of said tank; sensing means for sensing the level of vacuum within the heated tube; and means for quickly opening said quick-opening valve in response to said sensing means when the measured vacuum level reaches a predetermined vacuum level.

2. An apparatus as in claim 1 having also: a plurality of supplementary tanks; a plurality of pipes fluidly connecting each of said supplementary tanks to said imperforate tank; and means for selectively isolating each of said supplementary tanks from said imperforate tank.

3. An apparatus as in claim 1: having also valve means for isolating said imperforate tank from the tube.

4. An apparatus as in claim 1: having also measuring means for depositing in said container only a predetermined quantity of fusible particles.

5. An apparatus as in claim 4: wherein the flow area of said feedpipe is less than the flow area of said tube.

6. An apparatus as in claim 4: wherein said measuring means comprises weighing means.

7. An apparatus as in any one of claims 1 or 2 through 6: having also a dust collector located downstream of said imperforate tank and upstream of said vacuum pump.

8. An apparatus as in claim 2: having also a dust collector located downstream of said imperforate tank and upstream of said vacuum pump; and valve means for isolating said imperforate tank from the tube.

9. An apparatus as in claim 8: having also measuring means for depositing in said container only a predetermined quantity of fusible particles.

10. An apparatus as in claim 9: wherein the flow area of said feed pipe is less than the flow area of said tube.

11. An apparatus as in claim 10: wherein said measuring means comprises weighing means.

* * * * *